US006585637B2

(12) United States Patent
Brillhart et al.

(10) Patent No.: US 6,585,637 B2
(45) **Date of Patent: *Jul. 1, 2003**

(54) METHOD AND APPARATUS FOR FIXATION TYPE FEEDBACK REDUCTION IN IMPLANTABLE HEARING ASSISTANCE SYSTEMS

(75) Inventors: Bruce A. Brillhart, Minneapolis, MN (US); Kai Kroll, Minneapolis, MN (US)

(73) Assignee: St. Croix Medical, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/865,629

(22) Filed: May 25, 2001

(65) Prior Publication Data

US 2002/0035308 A1 Mar. 21, 2002

Related U.S. Application Data

(62) Division of application No. 09/172,884, filed on Oct. 15, 1998, now Pat. No. 6,261,223.

(51) Int. Cl.[7] ..... H04R 25/02
(52) U.S. Cl. ..... 600/25
(58) Field of Search ..... 600/25; 607/55–57; 381/23.1, 312, 317, 318, 322–326

(56) References Cited

U.S. PATENT DOCUMENTS 4,729,366 A * 3/1988 Schaefer ..... 600/25
4,850,962 A * 7/1989 Schaefer ..... 600/25
5,085,628 A * 2/1992 Engebretson et al. ..... 381/337
5,282,858 A * 2/1994 Bisch et al. ..... 381/162
5,558,618 A * 9/1996 Maniglia ..... 600/25
5,836,863 A * 11/1998 Bushek et al. ..... 381/326
5,857,958 A * 1/1999 Ball et al. ..... 600/25
5,899,847 A * 5/1999 Adams et al. ..... 600/25
5,935,166 A * 8/1999 Kennedy ..... 600/25
5,984,859 A * 11/1999 Lesinski ..... 128/898
5,993,376 A * 11/1999 Kennedy ..... 181/129
5,999,856 A * 12/1999 Kennedy ..... 381/60
6,001,129 A * 12/1999 Bushek et al. ..... 600/25
6,005,955 A * 12/1999 Kroll et al. ..... 381/312
6,139,488 A * 10/2000 Ball ..... 600/25
6,315,710 B1 * 11/2001 Bushek et al. ..... 381/312

* cited by examiner

*Primary Examiner*—Max F. Hindenburg
*Assistant Examiner*—Joseph A. Cadugan
(74) *Attorney, Agent, or Firm*—Fredrikson & Byron, P.A.

(57) ABSTRACT

A method and apparatus for improving hearing by preventing acoustic feedback from the ossicular chain into a middle ear-implanted microphone of an implantable hearing assistance system. Mechanical sound vibrations are received with an acoustic microphone implanted in the middle ear. The mechanical sound vibrations are converted to an amplified electrical signal and the amplified electrical signal is delivered to the inner ear with a transducer operatively coupled between the microphone and the inner ear. A mechanical feedback barrier is established by removing or separating a portion of the hearing-impaired person's ossicular chain (e.g., malleus or incus) to prevent transmission of sound feedback into the microphone from the tympanic membrane via the ossicular chain. Implanting an acoustic microphone permits alternative implantation methods other than a mastoidectomy. For example, the acoustic microphone can be inserted into the middle ear in a transcanal approach in which the microphone is inserted through a temporary slit in the tympanic membrane. The conductive lead wires can extend transdermally to the signal processor and/or battery located outside the middle ear.

33 Claims, 11 Drawing Sheets

METHOD AND APPARATUS FOR FIXATION TYPE FEEDBACK REDUCTION IN IMPLANTABLE HEARING ASSISTANCE SYSTEMS

This application is a divisional of co-pending, commonly assigned patent application entitled METHOD AND APPARATUS FOR FIXATION TYPE FEEDBACK REDUCTION IN IMPLANTABLE HEARING ASSISTANCE SYSTEM, Ser. No. 09/172,884, filed on Oct. 15, 1998, now U.S. Pat. No. 6,261,223.

BACKGROUND OF THE INVENTION

1. Field of the Invention

The present invention relates to implantable hearing systems for assisting hearing in hearing-impaired persons and in particular to middle ear-implanted acoustic microphone systems with acoustic feedback prevention.

2. Description of Related Art

Some implantable hearing assistance systems use a microphone located in or near the ear to convert acoustic sound energy into an electrical signal. The electric signal is amplified, modulated and then communicated by a transducer to directly stimulate the cochlea to assist hearing. Alternatively, the amplified signal is communicated to a transducer for conversion to mechanical acoustic energy for vibratory application to a structure of the middle ear or the cochlea. The microphone can be located externally, subdermally adjacent the ear, or within the external auditory canal. The transducer is commonly connected to a portion of the middle ear, known as the ossicular chain, which includes the malleus, incus and stapes. Vibrations are emitted from the transducer into and through the ossicular chain to the cochlea of the inner ear.

The ossicular chain facilitates forward transmission of mechanical sound vibrations from the tympanic membrane of the external auditory canal to the inner ear. However, the ossicular chain also permits reverse transmission of mechanical sound energy to be transmitted from the transducer of the implantable hearing assistance system, back through the ossicular chain to the tympanic membrane, and into the external auditory canal. This retrograde sound transmission passes out of the external auditory canal and is acoustically fed back to the microphone of the system.

This acoustic feedback limits the maximum gain which the hearing assistance system can apply to the signal received by the microphone. In particular, the feedback created by reverse bone conduction through the ossicular chain has an inverse relationship with usable gain. For example, if one percent of the acoustic vibratory signal emitted by the transducer to the stapes, or other part of the ossicular chain, is fed back through the ossicular chain and into the external auditory canal to the microphone, the gain for the hearing assistance system is limited to roughly 100 or 40 dB. Due to the nature of the hearing losses and the acoustic limitations of these systems, a much higher gain is ideal. Accordingly, reduction or elimination of this feedback is desirable.

Moreover, these hearing assistance systems, which transmit acoustic sound energy onto an ossicular chain with a transducer, are inefficient and consume power rapidly. Inefficiency results from the mechanical force that must be exerted by the transducer against the ossicular chain and/or the tympanic membrane (in the case of microphone transducers located in the external auditory canal). This inefficiency causes rapid power consumption, requiring frequent battery changes. Battery changes are, at least, inconvenient for an externally located battery, and at worst, costly and surgically-related for a battery implanted in the middle ear or subdermally.

The importance of restoring hearing to hearing-impaired persons demands more optimal solutions in hearing assistance systems. Ideally, an improved hearing assistance system both minimizes power consumption as well as maximizes gain to produce a better acoustic signal for reception into the cochlea and the inner ear.

SUMMARY OF THE INVENTION

A method and apparatus of the present invention improves hearing for a hearing-impaired person by preventing acoustic feedback from the ossicular chain into a middle ear-implanted microphone of an implantable hearing assistance system. In this method, mechanical sound vibrations impinging on the person's body habitus are received with an acoustic microphone implanted in the middle ear. The mechanical sound vibrations are converted with the microphone to an amplified electrical signal. Next, the amplified electrical signal is delivered to the middle ear by a transducer operatively coupled to the microphone. The transducer is preferably coupled to a stapes or any element of the ossicular chain connected to the stapes.

Finally, a mechanical feedback barrier is established by removing or separating a portion of the hearing-impaired person's ossicular chain (e.g., malleus or incus) to prevent transmission of sound feedback into the microphone from the tympanic membrane via the ossicular chain.

This method and apparatus of the present invention optimizes hearing improvement by preventing unnecessary acoustic feedback that can occur from an output transducer through the ossicular chain to the tympanic membrane, where an acoustic signal would otherwise be generated to create feedback in the acoustic microphone. Interrupting the ossicular chain, or otherwise immobilizing the ossicular chain, to prevent this retrograde sound transmission permits significant enhancement of the gain applied to the amplified electrical signal transmitted to the stapes. In addition, less mechanical energy is required to transmit the acoustic energy to stapes (a small load) with the interrupted ossicular chain than when the ossicular chain remains intact as in conventional systems in-the-canal in which the acoustic energy is transmitted to the tympanic membrane (a large load). Accordingly, this method and apparatus reduces power consumption and reduces frequent battery replacement for implantable hearing assistance systems and/or permits the use of smaller batteries as well as longer-life batteries that are the same size.

Finally, implanting an acoustic microphone permits alternative implantation methods other than a mastoidectomy. For example, the acoustic microphone can be inserted into the middle ear in a transcanal approach in which the microphone is inserted through a temporary slit in the tympanic membrane. The conductive lead wires can extend transdermally to the signal processor and/or battery located outside the middle ear. Other components may also be included outside the middle ear for external or transdermal battery recharging.

DETAILED DESCRIPTION OF THE PREFERRED EMBODIMENTS

Figure 1:
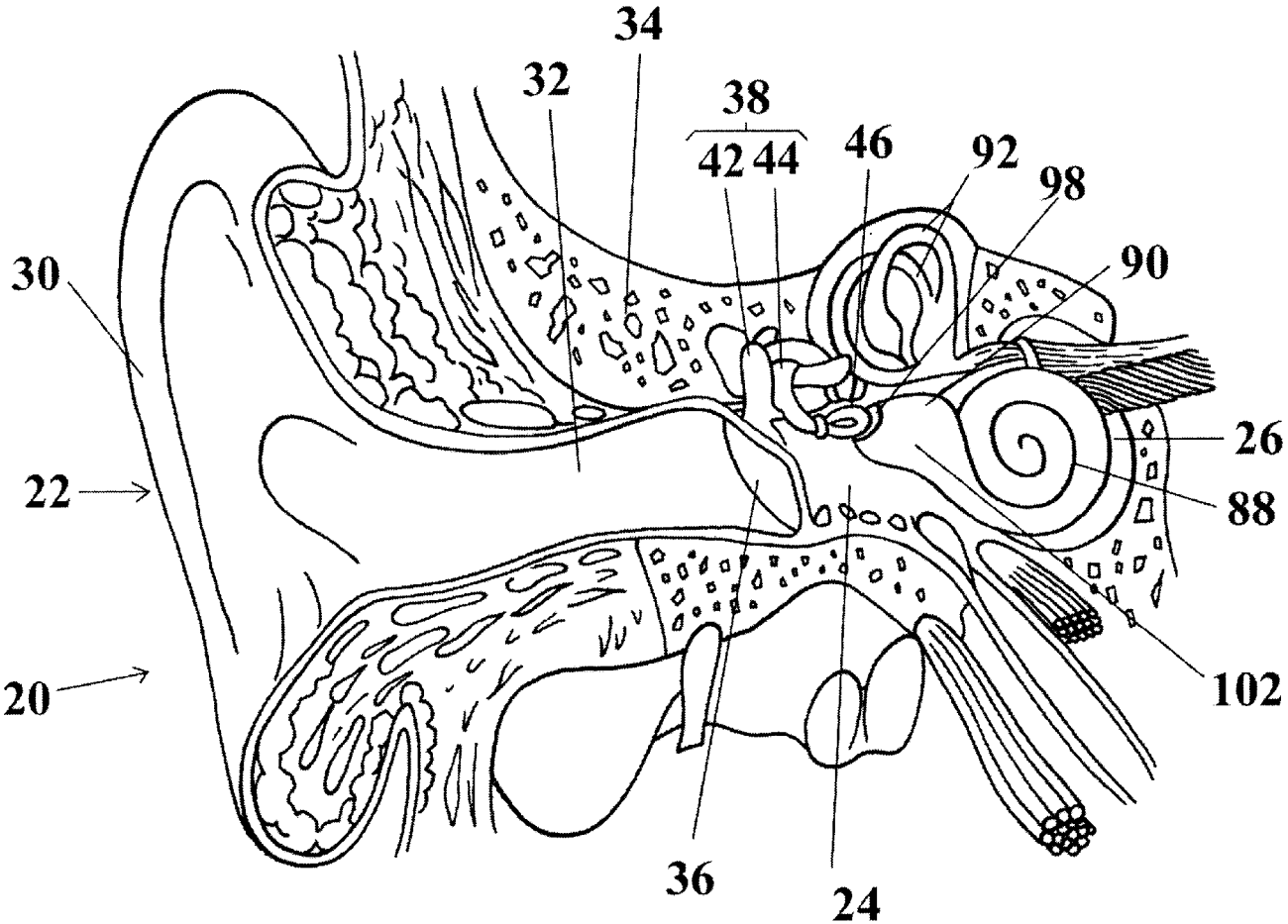
FIG. 1 is a plan view of an auditory system of a human subject.

The ear is the auditory organ of the body. As shown in FIG. 1, ear 20 includes outer ear 22, middle ear 24, and inner ear 26. Outer ear 22, in turn, includes the pinna 30, and exterior auditory canal (external acoustic meatus) 32 extending up to and including tympanic membrane 36. The pinna 30 is the ear flap and is visible on the exterior of the head. The exterior auditory canal extends through temporal bone 34.

Middle ear 24 begins at the interior terminus of exterior auditory canal 32, the tympanic membrane 36. Middle ear 24 includes the interior side of tympanic membrane 36 and ossicular chain 38. Ossicular chain 38, in turn, includes malleus (hammer) 42, incus (anvil) 44, and stapes (stirrup) 46.

Figure 2:
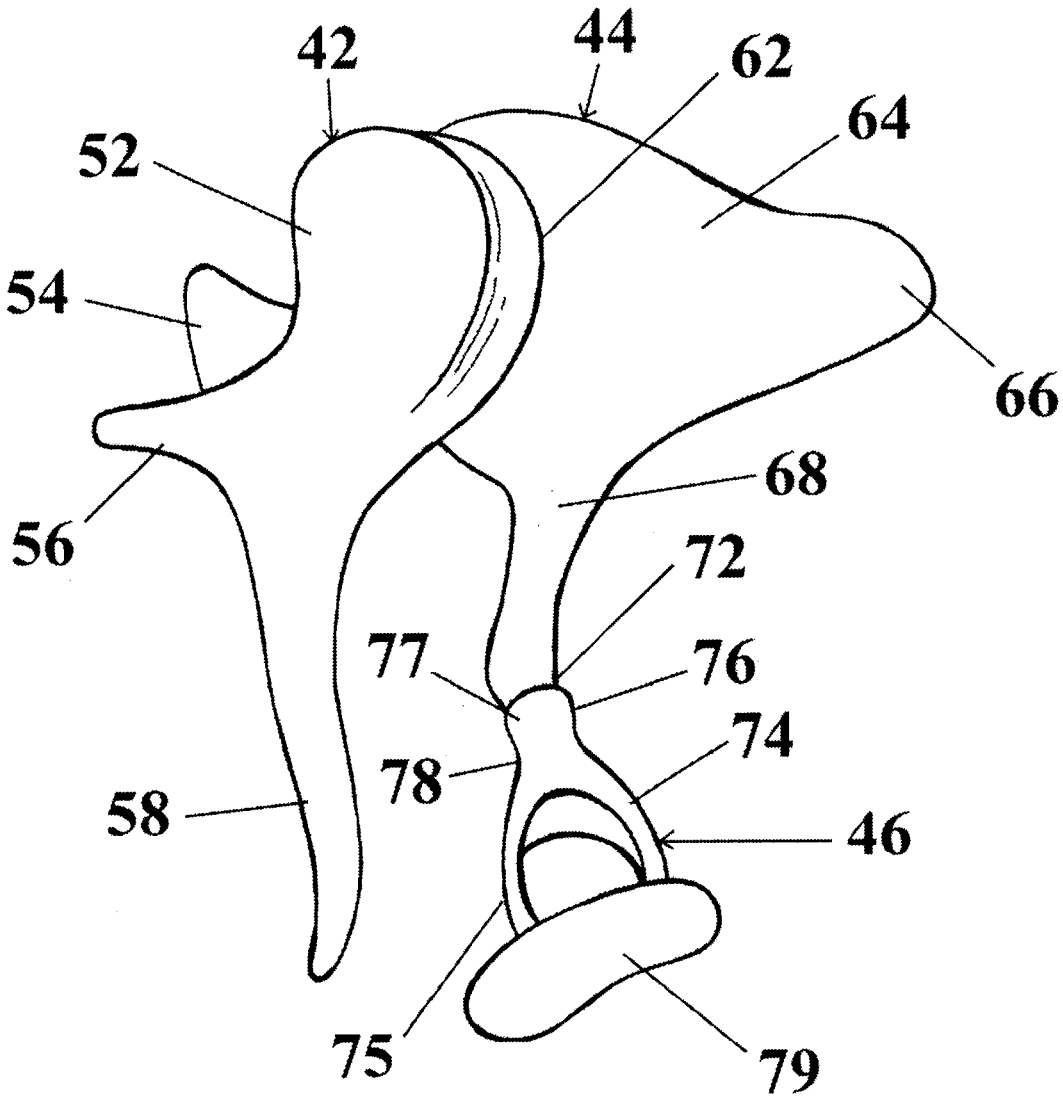
FIG. 2 is an enlarged plan view of an ossicular chain of the auditory system of FIG. 1.

As best seen from FIG. 2, malleus 42 includes head 52, lateral process 54, anterior process 56, and manubrium 58. Malleus 42 attaches to tympanic membrane 36 at manubrium 58. Incus 44 articulates with malleus 42 at incudomalleolar joint 62 and includes body 64, short crus 66, and long crus 68. Stapes 46 articulates with incus 44 at incudostapedial joint 72 and includes posterior crus 74, anterior crus 75, capitulum 76, and base (foot plate) 79. Capitulum 76 of stapes 46, in turn, includes head 77 and neck 78.

The base 79 of stapes 46 is disposed in and against a portion of the inner ear 26. Inner ear 26 includes cochlea 88, vestibule 90, and semicircular canals 92. Base 79 of stapes 46 attaches to oval window 98 on vestibule 90. Round window 102 is present on a more basal portion of vestibule 90. Oval window 98 and round window 102 are considered a portion of cochlea 88 in this patent application.

Sound waves are directed into exterior auditory canal 32 by outer ear 25. The frequencies of the sound waves may be slightly modified by the resonant characteristics of exterior auditory canal 32. These sound waves impinge upon tympanic membrane 36, thereby producing mechanical tympanic vibrations. The mechanical energy of the tympanic vibrations is communicated to inner ear organs cochlea 88, vestibule 90, and semicircular canals 92, by ossicular chain 38. Thus, tympanic membrane 36 and ossicular chain 38 transform acoustic energy in exterior auditory canal 32 to mechanical energy for transmission to cochlea 88.

Normally, tympanic vibrations are mechanically conducted through malleus 42, incus 44, and stapes 46 to oval window 98. Vibrations at oval window 98 are conducted into the fluid-filled cochlea 88. These mechanical vibrations generate fluidic motion, thereby transmitting hydraulic energy within cochlea 88. Receptor cells in cochlea 88 transmit the fluidic motion into neural impulses, which are transmitted to the brain and perceived as sound. Pressures generated in cochlea 88 by fluidic motions are also accommodated by round window 102. Round window 102 is a second membrane-covered opening between cochlea 88 and middle ear 24.

Hearing loss due to damage in cochlea 88 is referred to as sensorineural hearing loss. Hearing loss due to an inability to conduct mechanical vibrations through middle ear 24 is referred to as conductive hearing loss. Some patients have an ossicular chain 38 which lacks resiliency. Ossicular chains with insufficient resiliency are either inefficient or totally fail to transmit mechanical vibrations between tympanic membrane 36 and oval window 98. As a result, fluidic motion in cochlea 88 is attenuated and receptor cells in cochlea 88 fail to receive adequate mechanical stimulation. Damaged elements of ossicular chain 38 may further interrupt transmission of mechanical vibrations between tympanic membrane 36 and oval window 98.

Figure 3:
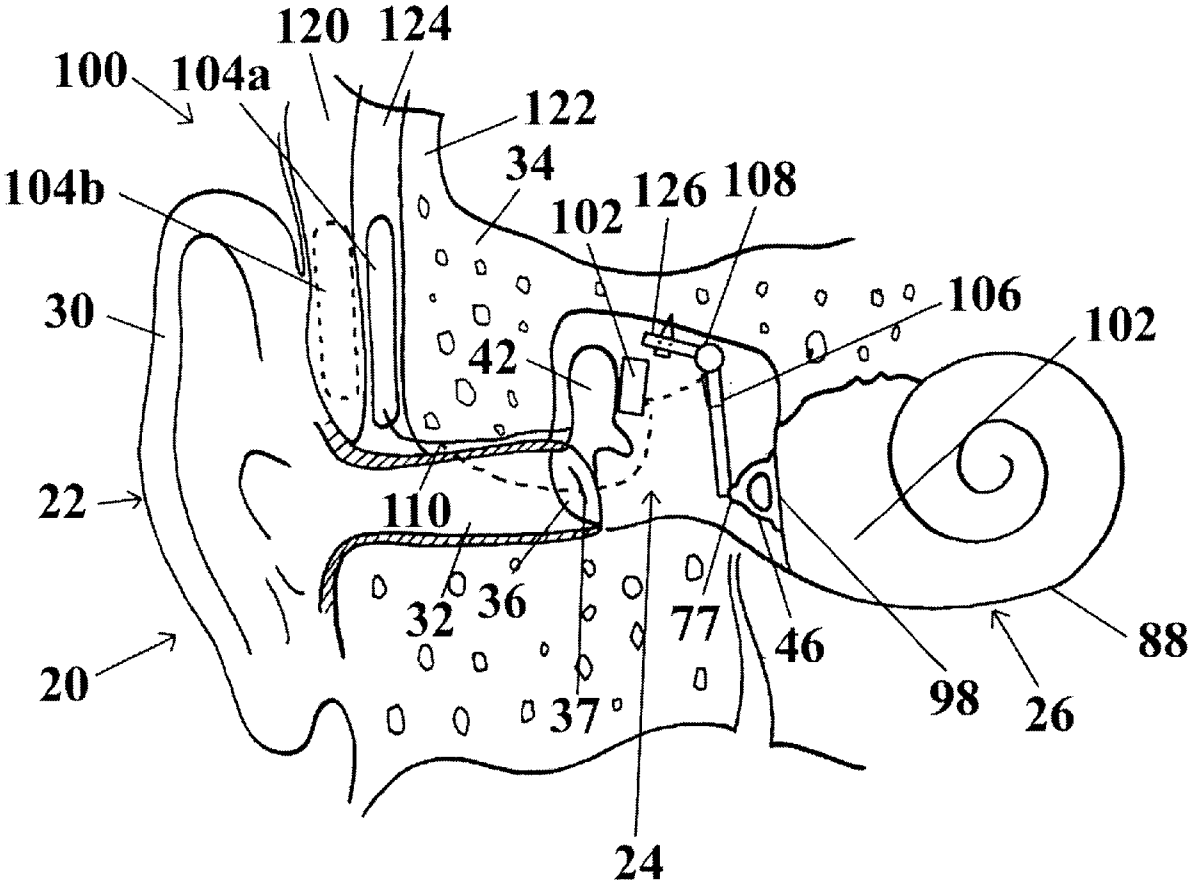
FIG. 3 is a sectional view of an auditory system of a human subject incorporating a first embodiment of an implantable hearing system of the present invention.

A partially implantable hearing assistance system 100 of the present invention for assisting a hearing-impaired person is shown generally in FIG. 3 as disposed within ear 20. It is recognized, however, that system 100 may be a dual system suitable for use with either one or both of a patient's ears. System 100 includes microphone 102, amplifier/signal processor 104A, transducer 106, and frame assembly 108. Electrical connection 110 extends from signal processor 104A to microphone 102 and transducer 106. A long lifetime power supply or battery is incorporated into signal processor 104.

Microphone 102 is an acoustic microphone for converting acoustic sound energy into an electrical signal. Microphone 102 is adhesively or mechanically fastened to malleus 42, or other structure within middle ear 24. Amplifier 104A is preferably attached to the patient's skull below tissue 120 subdermally within space 124. In another embodiment 95, shown in phantom as processor 104B in FIG. 3, signal processor 104A is shaped and sized for removable attachment about the ear 20, exterior to tissue 120. Amplifier 104A includes signal processing circuitry and is electrically connected to microphone 102 through tissue 120 via connection 110. For example, processor 104A includes an amplifier, appropriate filtering, limiting and compression, as well as output limiters, input limiters, transcutaneous, programmable features, and digital-based control circuitry with programmable memory. Both microphone 102 and amplifier 104A are miniature electronic modules.

Transducer 106 is disposed within middle ear space 24 and secured against a wall of middle ear space 24 or within mastoid cavity 126 against bone 34 with frame assembly 108 using one or more fastening means. Finally, transducer 106 is operatively connected to stapes 46. Electrical connection 110, which extends between microphone 102, amplifier 104A, and transducer 106, operatively communicatively couples transducer 106, amplifier 104A, and microphone 102.

With system 100, acoustic sound vibrations impinging on tympanic membrane 36 are received by acoustic microphone 102 and converted to an electrical signal and transmitted to amplifier 104A. After amplification and modulation, the electrical signal is communicated to transducer 106 via electrical connection 110. In response to the electrical signal, transducer 106 produces an acoustic vibratory signal that is applied to stapes 46 and ultimately, cochlea 88 via oval window 98. Microphone 102, amplifier 104A, and transducer 106 and their communication with each other may be of a type generally known to those skilled in the art, although improved means for each component are contemplated within the scope of this invention to facilitate improved implant procedures, to minimize invasiveness, and to improve the reliability of the transducer.

System 100 and the method of the present invention includes introducing and maintaining a mechanical feedback barrier to prevent mechanical or acoustic feedback through ossicular chain 38 and tympanic membrane 36 to microphone 102. This feedback barrier is preferably implemented by interrupting ossicular chain 38. However, freezing movement of ossicular chain 38 or otherwise isolating microphone 102 and transducer 106 from mechanical/acoustic feedback through ossicular chain 38 can also provide the necessary barrier. In addition, the feedback barrier can be accomplished through various sound dampening and sound isolation materials and/or techniques placed appropriately about, or between, one or more portions of the ossicular chain.

Figure 4:
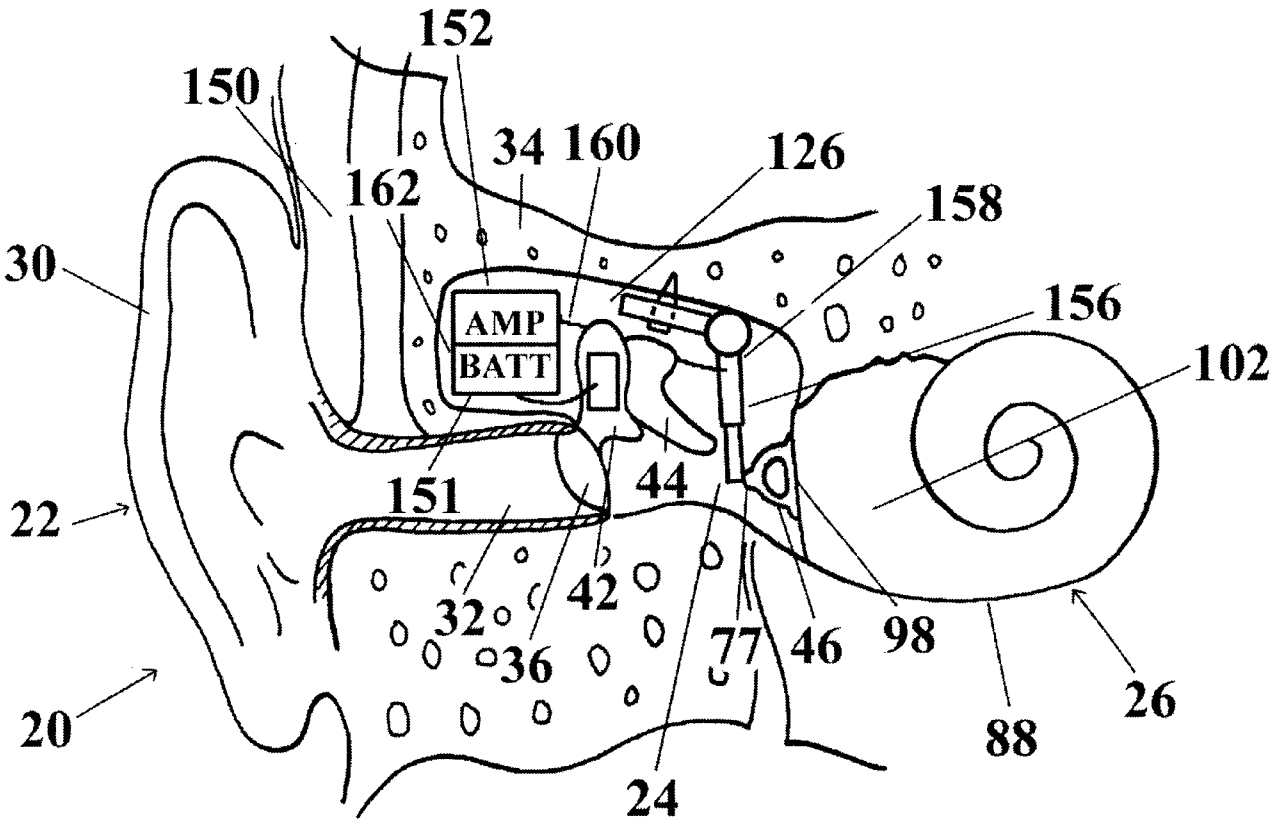
FIG. 4 is a sectional view of an auditory system of a human subject incorporating a second embodiment of an implantable hearing system of the present invention.

As shown in FIGS. 2 and 3, ossicular chain 38 including malleus 42, incus 44, and stapes 46 (FIG. 2) has been interrupted by disconnecting incus 44 from stapes 46 and removing incus 44 (FIG. 3). This interruption creates a barrier to prevent mechanical feedback of acoustic sound energy from transducer 106 through ossicular chain 38 and tympanic membrane, to middle ear-implanted microphone 102. Of course, the disarticulation of ossicular chain 38 could occur any place between tympanic membrane 36 (umbo) and transducer 106 so long as output transducer 106 imparts motion to a portion of the ossicular chain 38 that is still connected to stapes 46 and cochlea 88. For example, as shown in FIG. 4, incus 44 has merely been separated from stapes 46, then fixed within the middle ear, and not removed from middle ear space 24. A separation of at least 2 to 3 millimeters is maintained between incus 44 and stapes 46 to prevent mucosal growth or bone growth that could otherwise act to artificially rejoin incus 44 to stapes 46.

Finally, as again shown in FIG. 3, tympanic membrane 36 also includes temporary slit 37 to permit insertion and implantation of microphone 102 and/or transducer 106 and bracket 108 into middle ear space 24. Tympanic membrane 36 can be intact (except for slit 37) or can have an ear tube or similar means placed therein. The implantation of acoustic microphone 102 in middle ear 24 simplifies installation of system 100 since no bracket is required to support microphone 102 and the accompanying mastoidectomy conventionally associated with bracket supports can be avoided. Moreover, the middle ear-implanted microphone 102 takes advantage of the natural signal filtering, amplification and localization effects performed by the outer ear and external auditory canal 32. This method of implantation is further described in greater detail below in connection with FIGS. 6A–6C, and 7–9.

While removal of ossicular chain 38 has taken place in some prior methods and systems, such removal typically occurs to solve middle ear conduction-type hearing loss problems, or to remove diseased tissue and ossicular bones. Sensorineurally impaired patients have hearing impairments not caused by dysfunction of the middle ear conduction chain, i.e. ossicular chain 38. Accordingly, sensorineural impairments do not dictate removal of ossicular chain 38. In fact, some in the art believe it unethical, or at least inappropriate, to remove a healthy ossicular chain to remedy a hearing impairment. Accordingly, removing or freezing movement of a portion of ossicular chain 38, or otherwise isolating ossicular chain 38 from an implantable middle ear system, such as system 100, in sensorineurally impaired patients is a unique and counter-intuitive solution to reduce acoustic feedback and improve the gain of the hearing assistance system.

While maintaining ossicular chain 38 intact (in order to preserve a healthy ossicular chain 38 despite a hearing impairment) may appear to be less intrusive, a method of the present invention recognizes that unconditionally maintaining the chain can dramatically reduce the gain achieved by the implantable middle ear hearing assistance system due to the feedback phenomenon described above. In this manner, the choice to maintain ossicular chain 38 can actually impede improving hearing in hearing impaired patients, particularly those with sensorineural impairment. However, in certain circumstances according to each patient's middle ear morphology, this invention may not be limited to the class of patients which only includes those suffering from sensorineural impairment. Accordingly, the method of the present invention interrupts ossicular chain 38 to prevent feedback, particularly for sensorineurally impaired patients.

Another hearing assistance system 150 of the present invention is shown in FIG. 4. System 150 includes acoustic microphone 151, amplifier/signal processor 152, transducer 156, and frame assembly 158 with electrical connections 160 and 162. Microphone 151 has features and attributes similar to microphone 102 and is similarly implanted within middle ear space 24, preferably on malleus 42. Signal processor 152 includes an amplifier and signal processing characteristics for amplifying and filtering an electrical signal from microphone 151. A battery may be incorporated with signal processor 152 as shown, or optionally incorporated externally adjacent ear 20 and connected to amplifier 151. In addition, optionally battery in signal process 152 can be recharged without removal from its implanted location by a remote battery recharger. Transducer 156 may have features and attributes similar to transducer 106 and is, likewise, connected to stapes 46 via head 77. As in the embodiment of FIG. 3, transducer 136 can alternatively be operatively coupled to round window 102 or oval window 98 of cochlea 88. Electrical connection 162 extends between microphone 151 and processor 152 while electrical connection 160 extends between, and electrically couples processor 152 and transducer 156. As shown in FIG. 4, incus 44 was separated from stapes 46 to introduce and maintain a feedback barrier against transmission of mechanical sound energy through ossicular chain 38 and tympanic membrane 36 to microphone 132. Of course, as earlier noted, other portions can be removed from ossicular chain 38, or merely separated, to effect the disarticulation and interruption of ossicular chain 38 to prevent acoustic feedback, as long as output transducer 156 is connected to an auditory element still connected to stapes 46.

This method and system 132 enjoys advantages and features similar to system 100 as a result of the introduction of an acoustic feedback barrier between middle ear-implanted microphone 151 and transducer 156.

Figure 5:
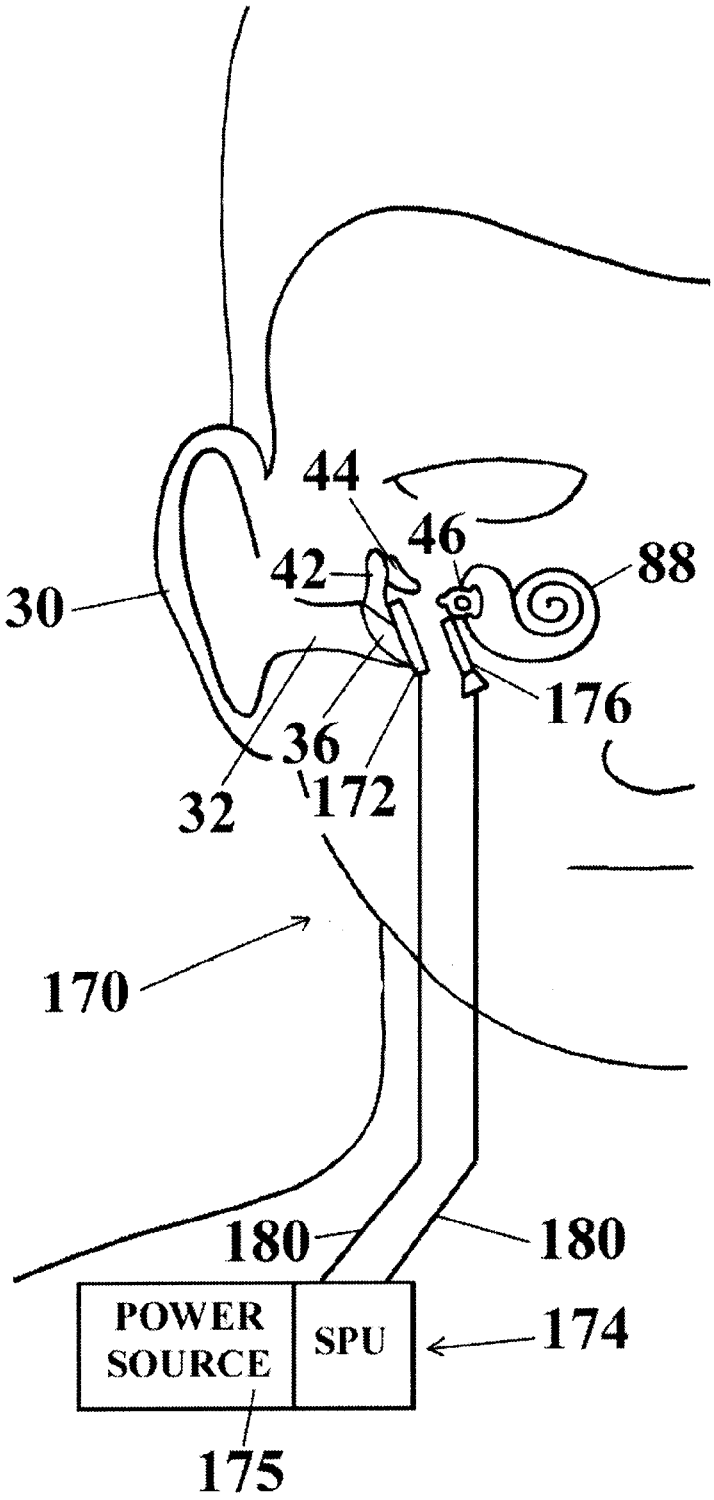
FIG. 5 is a sectional view of an auditory system of a human subject incorporating a third embodiment of an implantable hearing system of the present invention.

Another hearing system 170 of the present invention is shown in FIG. 5. System 170 includes an acoustic microphone 172 implanted in the middle ear cavity (preferably on malleus 42) and a remote signal processor unit (SPU) 174 (with optional power source 175) implanted pectorally, abdominally, or in some other body location remote from ear 20. System 170 further includes transducer 176, frame assembly (not shown), and electrical connection means 180. Transducer 176 is supported within the middle ear cavity 24 by a connection assembly (similar to support assemblies 108 and 158 in FIGS. 3 and 4) secured against bone 34 within the middle ear cavity. As before, transducer 176 is secured to head 77 of stapes 46 or, alternatively, secured to the oval or round windows of cochlea 88 in the absence of stapes 46. As in the other systems 100 and 150, disarticulation of the ossicular chain 38 creates a feedback barrier to prevent a retrograde transmission of sound energy through the external auditory canal 32 and tympanic membrane 36 to microphone 172. As shown, ossicular chain 38 has been interrupted, or disarticulated, by separating incus 44 from stapes 46. However, disarticulation could take other forms, including removal of incus 44, removal of malleus 42 or removal of stapes 46, or any combination thereof. Moreover, as discussed further below in connection with FIG. 9, disarticulation can include cutting or removing a portion of the incus to interrupt the ossicular chain, as well as other techniques.

As before, implanting microphone 172 in the middle ear takes advantage of the natural filtering process of the outer ear and external auditory canal 32 as well as optionally avoiding the need for a mastoidectomy or any similarly invasive procedure by using a transcanal middle ear implantation method via tympanic membrane 36. Implanting signal processor 174 with power supply 175 remotely from ear 20 (e.g. pectorally, abdominally, or other body location remote from the head and below neck) permits use of long life batteries that are of a larger size (e.g. not capable of implantation in middle ear 24) and easily accessible, as well as permitting incorporation of larger sized digital signal processing circuitry that requires more power. The power supply 175 can be sufficiently large or of long life to be nonrechargeable. For example, battery 175 can have a capacity of 4 amperehours or more, as disclosed in copending application Ser. No. 08/755,181, filed Nov. 25, 1996 and incorporated by reference herein.

Figure 6A:
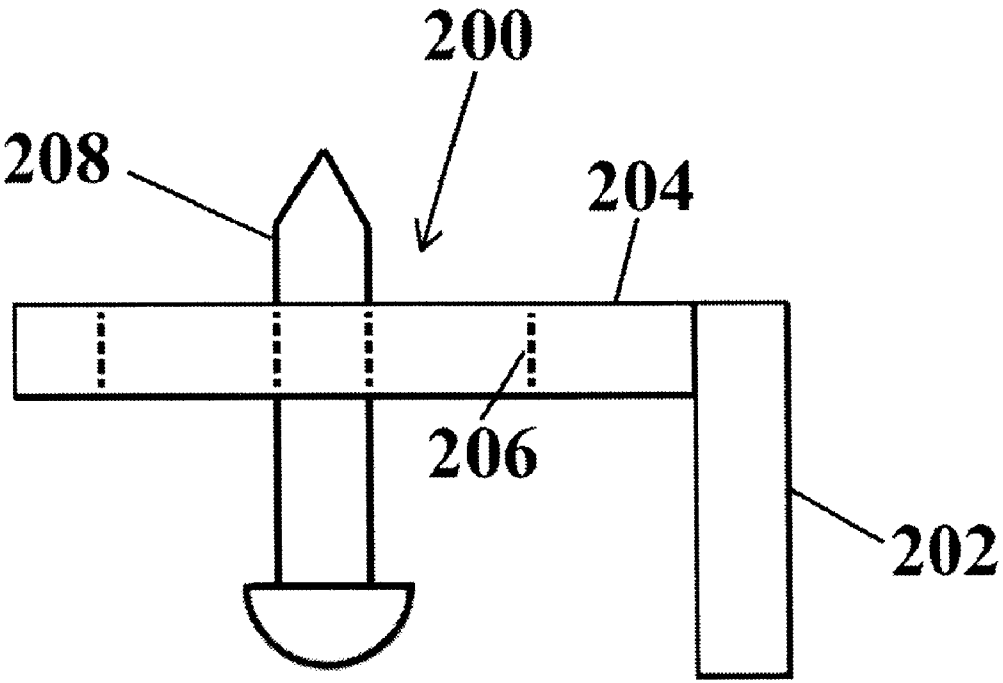
FIG. 6A is a plan side view of a mounting bracket of the present invention.
Figure 6B:
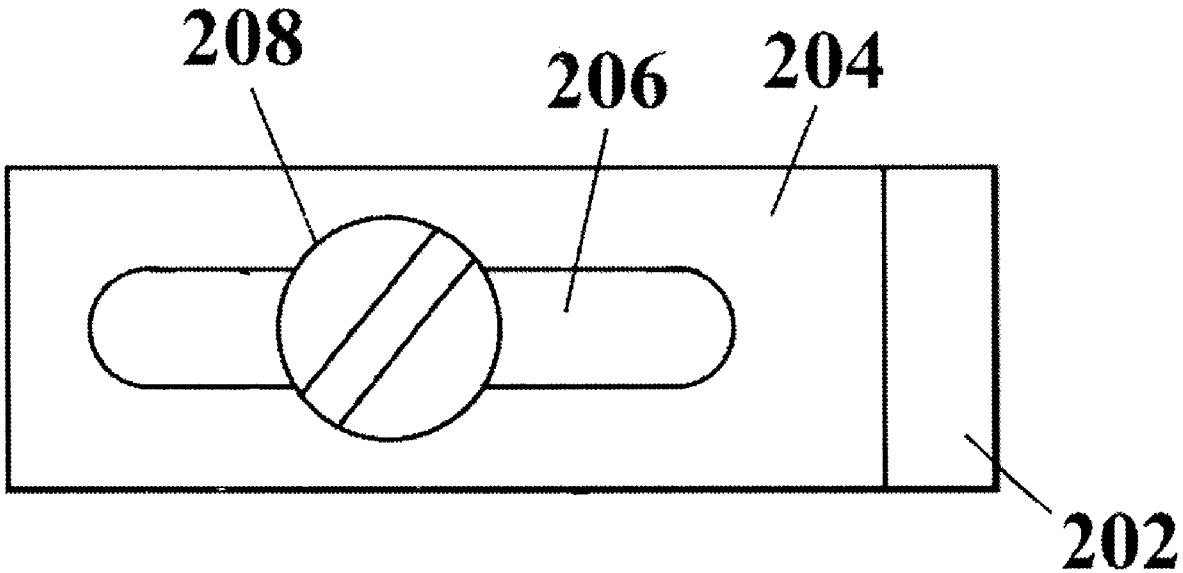
FIG. 6B is a plan top view of a mounting bracket of the present invention.
Figure 6C:
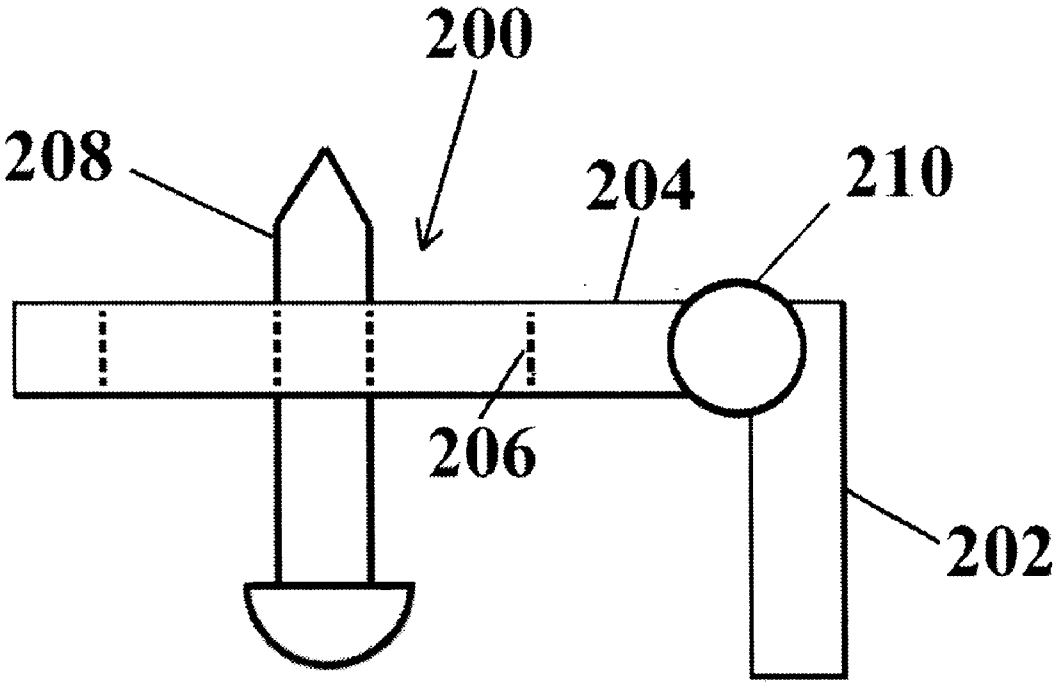
FIG. 6C is a plan side view of a modified mounting bracket of the present invention.

FIGS. 3 and 4 each show a mounting bracket (108, 158) for placing a transducer in contact with an auditory element, such as stapes 46. While brackets known in the art can be used, the methods and systems of the present invention may also use a bracket of the type similar to that shown in FIGS. 6A–6C. FIGS. 6A, 6B, and 6C show a bracket system 200 having a transducer 202 attached to the single bracket support 204. The single bracket support 204 includes an opening 206. A bone screw 208 or similar attaching means passes through the oblong opening 206 and allows for independent adjustment of the distance between the support mounting screw 208, which is typically a bone screw, and the transducer 202. Such adjustment allows considerable adaptability in that the single bracket support can be mounted with respect to different auditory elements, such as malleus 42 and stapes 46, respectively, in a patient population having varying anatomical features within middle ear 24.

The shape of single bracket support 204 in this embodiment is more or less a flat plate. The transducer 202 is coupled to the flat plate either adhesively, mechanically or otherwise, to produce a single component. It should be noted that other configurations are possible, depending on patient anatomy and other factors. A generally L-shaped bracket, a rectangular-shaped bracket, or any other shaped bracket that facilitates mounting of transducer 202 can be used in place of the single bracket support 204. The bone screw 208 couples the single bracket support 204 to the mastoid bone 34. Other types of fastening techniques can also be used. For example, single bracket support 204 can be shaped with a flange that could be attached to bone 34. The single bracket support 204 can be moved linearly and rotated with respect to the bone screw 200 to position the transducer 202 in a selected position with respect to one of the elements of the middle ear.

FIG. 6C shows an embodiment having a joint functioning as a universal connector 210 placed between the transducer 202 and the single bracket support 204. The universal connector 210 may also be placed between the two portions of the single bracket support 204. The universal connector 210, such as a ball and socket joint, allows further adjustability and 360-degree movement to position the transducer 202 against respective auditory elements 42 and 46.

Figure 8:
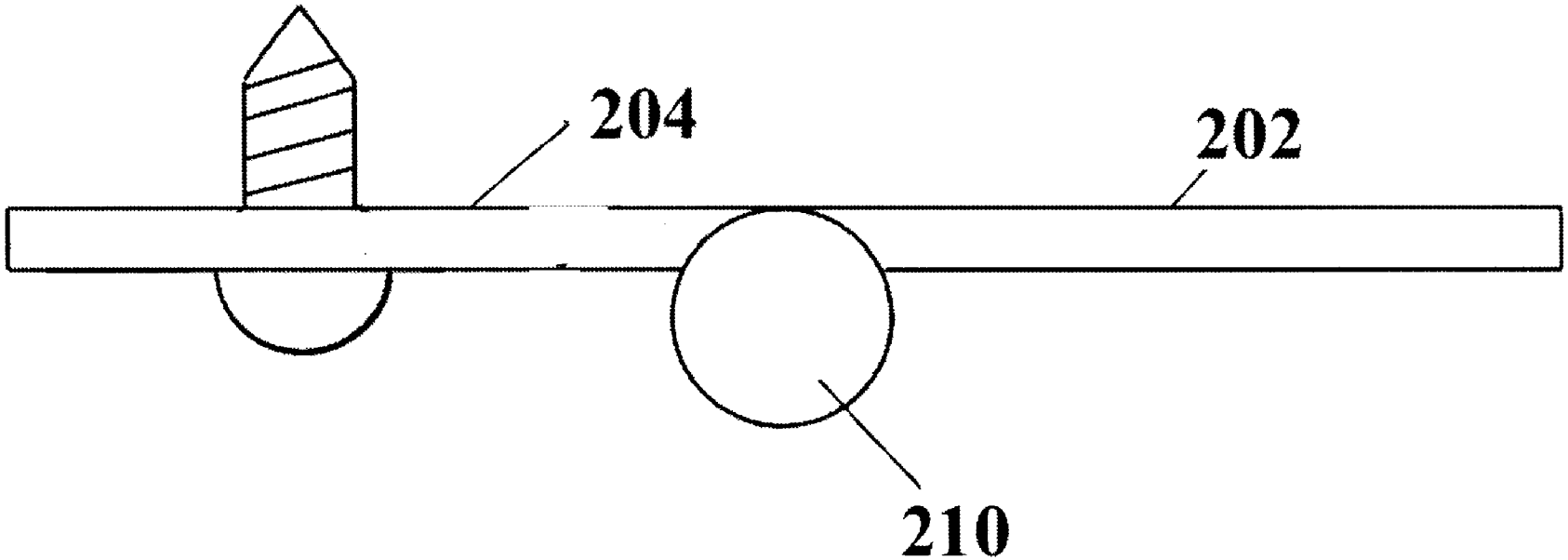
FIG. 8 is a plan side view of a mounting bracket of the present invention manipulated to a pre-insertion position.
Figure 9:
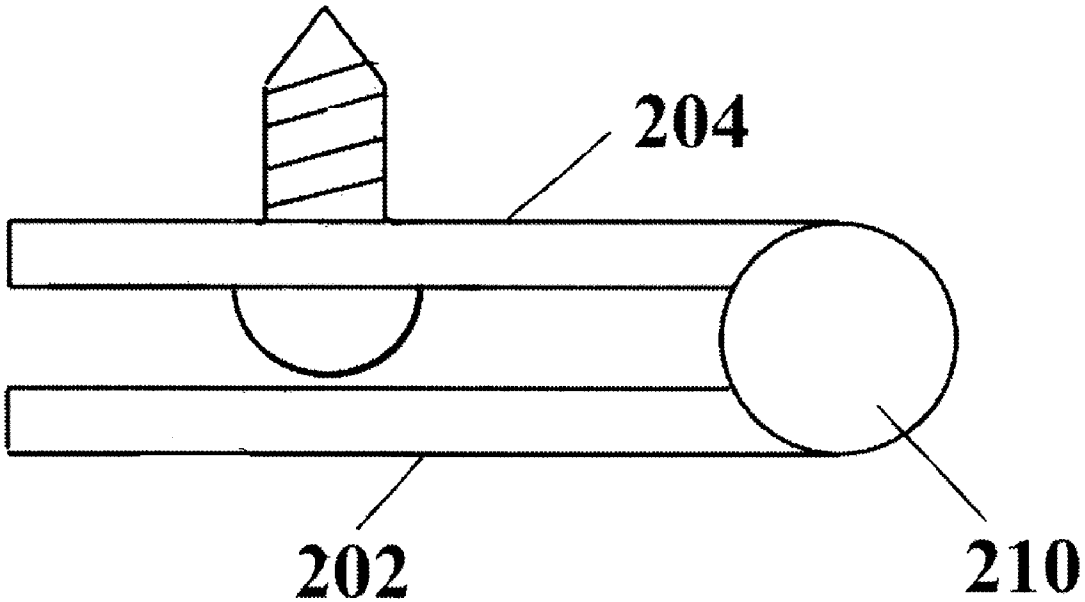
FIG. 9 is a plan side view of a mounting bracket of the present invention manipulated to a pre-insertion position.

As shown in later FIGS. 8 and 9, bracket system 200 can include multiple bracket supports 204 each having a universal connector 210 for adjustability, as well as multiple articulation means, such as certain portions of a bracket having more flexible material components to enable bending and other particular adjustments according to individual patient morphology. In addition, the bracket systems 200 can include multiple slots such as slot 206, laterally spaced from each other and having different lengths, to permit flexibility in selecting the length at which bracket support 204 extends outwardly from its point of attachment to the mastoid bone or other middle ear structure.

As shown in prior FIGS. 3 and 4, a fastener, such as bone screw 208 is attached to the bone 34 to secure the bracket 200 within middle ear space 24 and transducer 202 adjustably in contact with stapes 46. Of course, bracket 202 also permits transducer 202 to be adjustably in contact with malleus 42 via universal joint 210. The various transducer and mounting means of the invention facilitate a trans-canal implant procedure by which portions of the device of the invention are implanted, in one embodiment, through the auditory canal and the tympanic membrane into the middle ear.

Figure 7:
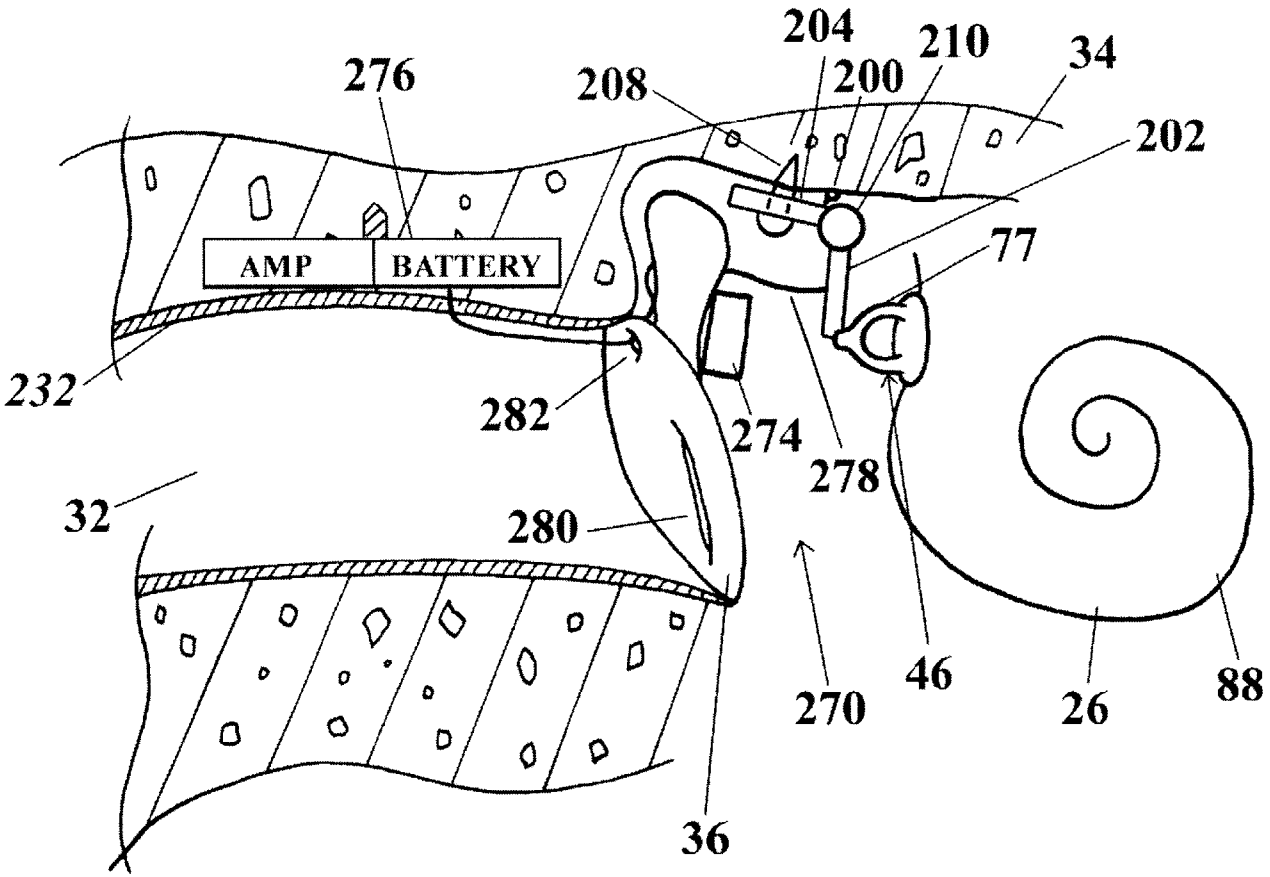
FIG. 7 a sectional view of an auditory system of a human subject incorporating another embodiment of an implantable hearing system and method of the present invention.

As shown in FIG. 7, a human auditory canal and middle ear are depicted with system 270 and a method of the present invention incorporated therein. System 270 for implementing a method of the present invention includes bracket system 200 (see FIGS. 6A–6C) having transducer 202, bracket support 204, positioning slot 206 (not seen in FIG. 7), fastener 208, and universal connector 210. System 270 further includes acoustic microphone 274, amplifier/electronics unit 276, lead wires 278. Finally, the method includes formation of slit or hole 280 in tympanic membrane 36.

In this method, microphone 274 preferably is located within the middle ear interior to tympanic membrane 36. This configuration takes advantage of the known sound filtering and amplification characteristics and localization effects of the outer ear 22 (including the structure shown in FIG. 1 extending from the pinna 30 to the tympanic membrane 36) of the human auditory system.

Amplifier/electronics unit 276 is placed in (or adjacent to) external auditory canal 32 or another location available (e.g., pectoral, or outside skull) to avoid a mastoidectomy procedure. Placement of amplifier/electronics unit 276 at location outside the middle ear, for example, at a pectoral location as in FIG. 5, permits the use of long life batteries having a size normally unsuitable for middle ear implantation and/or permits easier battery replacement. Amplifier 276 is electrically connected to microphone 274 with connection means, such as lead wires 278. In one embodiment, lead wires 278 pass through slit 282 (or slit 280) of tympanic membrane 36 for connection to transducer 202. In another embodiment, lead wire(s) or connection means 278 may tunnel adjacent to tympanic membrane through a simple surgical process, and thus avoid any continuous penetration through the tympanic membrane.

The following method of insertion is used for implanting at least transducer 202, microphone 274 (in phantom in FIG. 10) or any other component of hearing assistance system 270 within middle ear space 24.

First, transducer 202 is affixed to a mounting bracket prior to insertion in the middle ear. The mounting bracket system 200 preferably includes a universal joint 210 disposed between a first elongate portion (support 204) and a second elongate portion (transducer 202). The second portion 202 commonly includes both a support and the transducer affixed together.

Prior to insertion in the middle ear, first portion 204 and second portion 202 of mounting bracket system 200 are manipulated to be aligned in an elongate configuration generally parallel along a single axis. The configuration can include either arranging first portion 204 and second portion 202 of the mounting bracket 200 in a side-by-side relationship generally parallel to each other as shown in FIG. 9, or as shown in FIG. 8, arranging first portion 204 and second portion 202 of mounting bracket 200 in an end-to-end relationship (aligned generally parallel along a single axis). In general, first portion 204 and second portion 202 need not be generally parallel but can be in any configuration (e.g., 45°, 90°, or other suitable angle) that facilitates insertion of mounting bracket 200 into the middle ear space 24 through tympanic membrane 36.

Next, using surgical techniques known to those skilled in the art, a low profile entry slit or hole 280 is created in tympanic membrane 36. With the mounting bracket system 200 and transducer in one of the above low profile configurations (see, e.g., FIG. 9), mounting bracket 200 is inserted into and through slit 280 in tympanic membrane 36. After first portion 204 and second portion 202 of mounting bracket 200 are reconfigured into an operative in-use configuration (e.g., 30°, 60°, 90°, or any other suitable angle), bracket 200 is then mounted against a wall of the middle ear space or against bone 34 as shown.

Of course, microphone 274 can be inserted through tympanic membrane 36 similarly without the use of bracket 200 since microphone 274 can be adhesively fastened to malleus 42 and other bony structures within middle ear 24. Alternatively, microphone 274 can be inserted through tympanic membrane 36 on a bracket support similar to bracket support 200.

In a system, such as that shown in FIG. 7 (electronics unit 276 external to middle ear), middle ear implantation of transducer 202 and microphone 274 via tympanic membrane 36 avoids a costly and maximally invasive mastoidectomy, or other similarly invasive procedure. After insertion of the transducer 202 through slit 280, tympanic membrane 36 will heal appropriately.

This method permits insertion of a device such as a bracket/transducer combination into the middle ear without a mastoidectomy where the bracket/transducer can be deployed in the middle ear space in a configuration different than the configuration used for insertion through tympanic membrane.

Moreover, the method of insertion/implantation through tympanic membrane 36 according the present invention is not limited to the use of bracket 200. Accordingly, any transducer or component of a hearing assistance system can be inserted through tympanic membrane 36 without a bracket like bracket system 200 for implantation in middle ear 24. For example, the other systems shown in FIGS. 2–6, 8–9 that have at least a transducer or electromechanical device or component of a hearing assistance system can be implanted with the just described method of insertion instead of using a mastoidectomy.

Moreover, bracket system 200 (e.g. FIGS. 8 and 9) can be modified to further ease insertion and implantation of a hearing assistance component via tympanic membrane 36. For example, portions 202 and 204 can be removably connected to each other (such as at joint 210) so that each piece can be inserted through tympanic membrane separately and then connected once both portions 202 and 204 are within middle ear space 24. Moreover, the tympanic membrane insertion method is particularly advantageous when combined with improved sizing methods using bracket systems with removable portions. In this example, the bracket support position 204 is implanted in middle ear space 24, a dummy transducer like transducer 202 is then inserted into middle ear 24 via tympanic membrane 36 and used to presize the appropriate sized transducer 202 that will be removably connected to bracket support 204. After removal of the dummy presizing transducer, a transducer 202 is inserted through tympanic membrane 36 and removably connected to bracket support 204 (already secured to bone 34).

The method and system of the present invention improves hearing assistance for the hearing-impaired in implantable hearing systems using an acoustic microphone implanted in the middle ear by neutralizing acoustic feedback through the ossicular chain and external auditory canal. The method can be employed in virtually all combinations of implantable systems having signal processors located remotely, subdermally, within the middle ear, or within or along the external auditory canal. Elimination of acoustic feedback through the ossicular chain produces better gain in these systems, and reduces power consumption since less mechanical force is required to transmit acoustic signals into the inner ear (via stapes or not) with an interrupted ossicular chain. Moreover, the methods of the present invention are minimally invasive procedures using tympanic insertion of a microphone, transducer, or mounting bracket and/or include reversible procedures using separation of the ossicular chain without removal of any auditory elements.

Although the present invention has been described with reference to preferred embodiments, workers skilled in the art will recognize that changes may be made in form and detail without departing from the spirit or scope of the present invention.

What is claimed is:

1. A method for assisting hearing for a hearing-impaired person comprising:

receiving sound vibrations impinging on the person's body habitus with an acoustic microphone disposed within the middle ear and converting the sound vibration with the microphone to an amplified electrical signal with a signal processor disposed on the person's body habitus;

delivering the amplified electrical signal to the inner ear with a transducer operatively coupled between the microphone and the inner ear;

maintaining a mechanical feedback barrier between the microphone and the inner ear to minimize feedback therebetween during the receiving and delivering steps.

2. The method of claim 1, wherein the maintaining step further comprises:

interrupting the ossicular chain.

3. The method of claim 2, wherein the interrupting the ossicular chain step is accomplished by removing an incus from the middle ear.

4. The method of claim 2, where the interrupting the ossicular chain step is accomplished by separating an incus from a stapes and mallus, and then fixing the position of the incus within the middle ear.

5. The method of claim 1, wherein the receiving step further comprises:

disposing the signal processor externally of the skull.

6. The method of claim 1, wherein the receiving step further comprises:

disposing a power supply, operatively coupled to the signal processor, externally of the skull.

7. The method of claim 1, wherein the receiving step further comprises:

disposing the signal processor within the external auditory canal.

8. The method of claim 1, wherein the receiving step further comprises:

disposing a power supply, operatively coupled to the signal processor, within the external auditory canal.

9. The method of claim 1, wherein the receiving step further comprises:

disposing the signal processor within the middle ear cavity.

10. The method of claim 1, wherein the receiving step further comprises:

disposing a power supply, operatively coupled to the signal processor, within the middle ear cavity.

11. The method of claim 1, wherein the receiving step further comprises:

disposing the signal processor subdermally adjacent the ear.

12. The method of claim 1, wherein the receiving step further comprises:

disposing a power supply, operatively coupled to the signal process, subdermally adjacent the ear.

13. The method of claim 1, wherein the receiving step further comprises:

disposing the signal processor remotely in a pectoral or abdominal region of the body habitus.

14. The method of claim 1, wherein the receiving step further comprises:

disposing a power supply, operatively coupled to the signal processor, remotely in a pectoral or abdominal region of the body habitus.

15. The method of claim 1, wherein the receiving step and the delivering step further comprises:

disposing the signal processor remotely in a pectoral or abdominal region of the body habitus;

operatively coupling the microphone to the transducer with an electromechanical linkage.

16. The method of claim 15, wherein the operative coupling step further comprises:

arranging a connection assembly within the middle ear to secure the microphone and the transducer relative to the cranium and a portion of the ossicular chain.

17. The method of claim 16, wherein the connection assembly further comprises a bracket.

18. The method of claim 16, wherein the connection assembly further comprises a hanger.

19. The method of claim 16, wherein the connection assembly further comprises a combination mounting bracket and removable portion.

20. The method of claim 1, wherein the delivering step further comprises:

operatively connecting the transducer to at least one of a stapes and an incus of the middle ear.

21. The method of claim 1, wherein the transducer comprises a piezoelectric transducer.

22. The method of claim 1, wherein the transducer comprises an electromagnetic transducer.

23. The method of claim 1, wherein the microphone further comprises a directional microphone for enhancing sound reception of sound energy traveling into the external auditory canal toward the tympanic membrane and for excluding sound energy traveling outwardly away from the tympanic membrane.

24. A method for assisting hearing for a hearing-impaired person comprising:

receiving sound vibrations impinging on the person's body habitus with an acoustic microphone disposed within the middle ear and converting the sound vibration with the acoustic microphone and a signal processor disposed on the person's body habitus to an amplified electrical signal;

delivering the amplified electrical signal to the inner ear with a transducer operatively coupled between the acoustic microphone and the inner ear;

prior to the receiving and the delivering steps, inserting at least one of the acoustic microphone and the transducer means through the tympanic membrane for implantation in the middle ear.

25. The method of claim 24, further comprising the step of:

maintaining a mechanical feedback barrier between the acoustic microphone and the inner ear to minimize feedback therebetween during the receiving and delivering steps.

26. The method of claim 24, wherein the microphone is affixed to the malleus within the middle ear adjacent to the tympanic membrane.

27. The method of claim 24, wherein the inserting step further comprises:

prior to insertion in the middle ear, affixing at least one of the microphone and the transducer to a mounting bracket.

28. The method of claim 27, wherein the inserting step further comprises:

inserting a first portion of the mounting bracket through the tympanic membrane and securing the first portion within the middle ear space; and inserting a second portion of the mounting bracket through the tympanic membrane and removably connecting the second portion to the first portion.

29. The method of claim 28, wherein the second portion further comprises the transducer or the microphone.

30. The method of claim 27, wherein the inserting step further comprises:

inserting the mounting bracket having a first portion and a second portion, with the first portion and the second portion coupled at a selectively pivotal joint, into and through the tympanic membrane while the first portion is arranged relative to the second portion in a first configuration;

manipulating the first portion and the second portion relative to each other into a second configuration; and securing the mounting bracket within the middle ear space in the second configuration.

31. The method of claim 30, wherein the first portion comprises the microphone or the transducer.

32. The method of claim 24, wherein the receiving step further comprises:

disposing the signal processor remotely in a pectoral region of the body habitus.

33. The method of claim 24, wherein the receiving step further comprises:

disposing the signal processor cranially external to the middle ear.

* * * * *